United States Patent [19]

Di Russo

[11] 4,189,132

[45] Feb. 19, 1980

[54] SAUSAGE CUTTING DEVICE

[76] Inventor: Augustine P. Di Russo, 151 Washington St., Lowellville, Ohio 44436

[21] Appl. No.: 917,518

[22] Filed: Jun. 21, 1978

Related U.S. Application Data

[63] Continuation-in-part of Ser. No. 802,111, May 31, 1977, abandoned.

[51] Int. Cl.[2] ..... B25B 1/24

[52] U.S. Cl. ..... 269/295

[58] Field of Search ..... 269/87.2, 290–295; 83/454, 455, 761–767, 437

[56] References Cited

U.S. PATENT DOCUMENTS 4,085,926 4/1978 Post et al. ..... 269/295

FOREIGN PATENT DOCUMENTS 179015 8/1935 Switzerland ..... 269/292

*Primary Examiner*—Robert C. Watson

*Attorney, Agent, or Firm*—Webster B. Harpman

[57] ABSTRACT

A device on which several continuous lengths of sausage in casings can be positioned and cut into equal sized portions comprises an integral body member with the upper surface thereof having a plurality of parallel sausage receiving channels therein with a plurality of longitudinally spaced narrow slots crosswise thereof in spaced relation to one another so as to provide knife guides. The channels take the form of spaced adjacent half circular shapes and the plurality of channels permit a number of continuous lengths of sausage in casings to be positioned thereon and simultaneously cut into uniform portions.

5 Claims, 3 Drawing Figures

SAUSAGE CUTTING DEVICE

This application is a C.I.P. of Ser. No. 802,111 filed May 31, 1977 and now abandoned.

BACKGROUND OF THE INVENTION (1) Field of the Invention

This invention relates to a cutting device having means for holding articles to be cut and having guide means for knives used in cutting the articles positioned therein.

(2) Description of the Prior Art

Prior devices may be seen in U.S. Pat. No. 328,955 of Oct. 27, 1885 to O. Andrews and U.S. Pat. No. 1,434,675 of Nov. 7, 1922 to U.S. Boone.

The first of these patents shows a fish cutting board with deep narrow parallel slots extending lengthwise and transversely of a board, the deep narrow slots form guide means for a knife used in cutting a fish positioned on the board. The patent neither suggests nor would make obvious to one skilled in the art the formation of a sausage cutting device having a plurality of spaced channels which can receive and hold continuous lengths of sausage in casings and provide knife guides crosswise of the channels as in the present invention.

U.S. Pat. No. 1,434,675 shows a board with transverse and longitudinal narrow shallow grooves upon which adhesive plasters may be positioned for cutting into desired lengths. The foregoing remarks with respect to U.S. Pat. No. 328,995 and a comparison thereof with applicant's presently disclosed invention apply equally well thereto.

SUMMARY OF THE INVENTION

A sausage cutting device comprises a body having a plurality of spaced sausage shaped channels positioned transversely thereof with a number of spaced right angular knife guiding slots extending from the uppermost portions of the channels downwardly therethrough. The sausage shaped channels receive and position and retain continuous lengths of sausage in casings positioned therein longitudinally of the device so that each of the lengths extends over the plurality of the deep knife guiding slots.

DESCRIPTION OF THE PREFERRED EMBODIMENT

Figure 1:
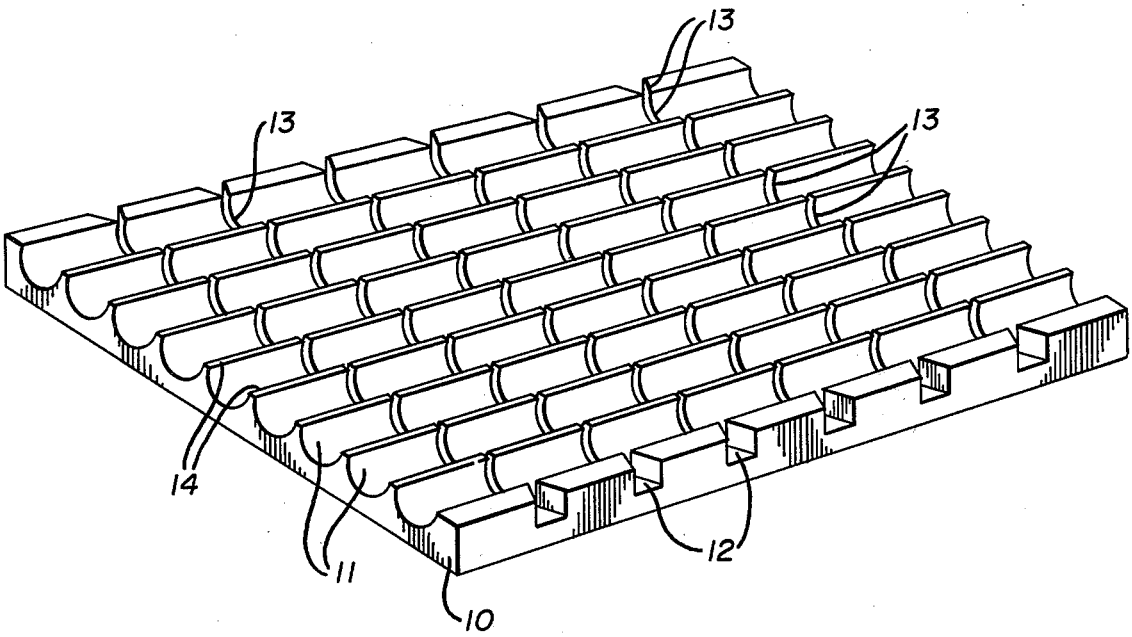
FIG. 1 is a perspective view of a sausage cutting device embodying the present invention.
Figure 2:
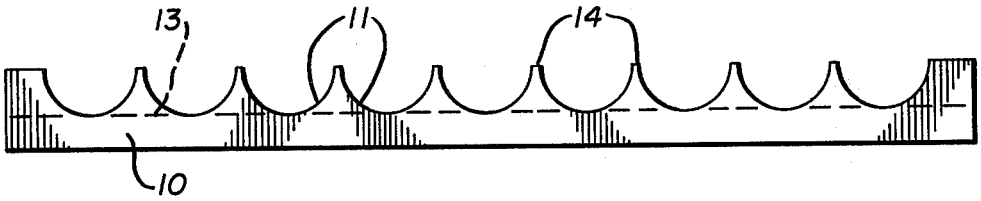
FIG. 2 is a side elevation thereof.
Figure 3:
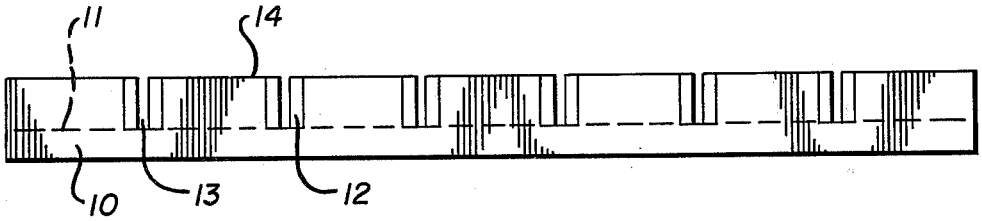
FIG. 3 is a front elevation thereof.

In the form of the invention chosen for illustration herein as seen in FIG. 1 of the drawings, the sausage cutting device comprises a body 10 preferably rectangular and formed of a desirable sterilizable material such as a high density resin. A plurality of sausage receiving and holding channels 11 are formed in the body 10 extending from one side thereof to the other. The half circular configurations of the channels 11 may best be seen in FIG. 2 of the drawings, and in FIGS. 1 and 3 of the drawings, V-shaped apertures 12 in the front edge of the body 10 may be seen.

Narrow knife guides in the form of narrow slots 13 are formed in the cutting device body 10 at right angles to the channels 11 and spaced with respect to one another evenly so that equal lengths of sausage may be cut by a knife successively drawn through each of the guiding slots 13.

The sausage cutting device illustrated in FIG. 1 of the drawings represents an overall length of approximately fifty inches and a width of twenty inches and each section of the sausage shaped channels 11 between the guide slots 13 is six and seven-eighths inches long as defined by the knife guiding slots 13 which are spaced longitudinally with respect to one another in the body 10 and are an eighth of an inch wide so as to form the knife guiding slots 13 which extend from the uppermost surfaces 14 of the body which lie between the half circular shaped channels 11.

By referring now to FIG. 1 of the drawings, it will be seen that the channels 11 in the body 10 form nine cross sectionally half circular shaped depressions, each of which is approximately two inches deep and two inches wide and that continuous lengths of sausage in casings may be positioned longitudinally of the sausage cutting device as seen in FIG. 1 of the drawings so that nine lengths may be positioned at one time on the sausage cutting device and held in spaced parallel relation by the shaped channels 11. When the channels 11 are filled to capacity, a knife may be drawn transversely of the device and the sausage in the casings, the knife being guided by the knife guiding slots 13 and the several lengths of sausage in casings in the device are therefore simultaneously cut into equal length portions, each piece being of the controlled diameter of the sausage initially positioned in the cutting device and of a uniform length of approximately seven inches. The size and shape and weight of the individual portions of sausage are thus accurately controlled by the cutting of the sausage in the casings by the device comprising the invention disclosed herein.

It will occur to those skilled in the art that the half circular configuration of the channels 11 makes it possible to vary the diameter of the sausage in casings positioned in the device for cutting as lengths of sausage in casing of various diameters will be held and positioned for cutting. The half circular configuration of the channels 11 also contributes to the efficiency of the cutting operation by one or more knives as the knife moves transversely of the board between the plurality of channels 11 so that particles of sausage meat adhering to a knife blade are continuously removed by the curved surfaces of the guide slots 13 formed by the spaced channels 11.

After use the sausage cutting device is easily cleaned as all of the surfaces of the body 10 can be reached with a stream of sterilizing solution directed into the channels 11 and through the knife guiding slots 13.

The body 10 is preferably formed of high density resin which may be steam sterilized or it can be formed of ceramic or stainless steel so that it may be completely cleaned and sterilized after each use.

The sausage cutting device as disclosed herein solves the problem faced by sausage manufacturers who produce a sausage in casing product and sell it in prepackaged portions of uniform size and weight as is required in serving institutional and restaurant trades.

Although but one embodiment of the present invention has been illustrated and described, it will be apparent to those skilled in the art that various changes and modifications may be made therein without departing from the spirit of the invention and having thus described my invention what I claim is:

1. A sausage portion cutting device comprising a unitary body member having a plurality of spaced parallel rows of cross sectionally curved channels forming its upper surface, said rows of channels extending across said body member in one direction and a plurality of equally spaced parallel rows of narrow knife guiding slots in said body member extending at right angles to said channels wherein sections of the channels in each of said rows are separated by the slots and are in end to end alignment with one another, said channels arranged to receive continuous lengths of sausage in casings whereby a knife moved through said narrow slots will cut said length of sausage in casings into portions of equal length.

2. The sausage portion cutting device set forth in claim 1 and wherein said body member has narrow flat upper surfaces between each of said curved channels.

3. The sausage portion cutting device of claim 1 and wherein said unitary body member is formed of a high density sterilizable material.

4. The sausage portion cutting device of claim 1 and wherein said body member on the sides of said narrow slots closely engages a knife-blade positioned therein so as to clean the same as the knife blade is drawn therethrough.

5. The sausage cutting device set forth in claim 1 and wherein said rows of channels are each half circular in cross section.

* * * * *